US005896907A

United States Patent [19]

Dever et al.

[11] Patent Number: 5,896,907

[45] Date of Patent: Apr. 27, 1999

[54] ROLLING FIRE DOOR INCLUDING A DOOR HOLD-OPEN/RELEASE SYSTEM

[75] Inventors: James E. Dever; Richard M. A. Rodgers, both of Tresckow, Pa.

[73] Assignee: Cornell Iron Works, Inc., Mountaintop, Pa.

[21] Appl. No.: 08/956,546

[22] Filed: Oct. 23, 1997

Related U.S. Application Data

[60] Provisional application No. 60/029,358, Oct. 31, 1996.

[51] Int. Cl.[6] ..... E05F 15/20

[52] U.S. Cl. ..... 160/6; 160/7; 160/9

[58] Field of Search ..... 160/1, 2, 6, 7, 160/9, 10, 23.1, 133, 191, 192, 290.1, 310, 405

[56] References Cited

U.S. PATENT DOCUMENTS

| | | | |
|---|---|---|---|
| 499,647 | 1/1893 | Tufts | 160/1 |
| 715,816 | 12/1902 | Kinnear | 160/1 |
| 1,011,691 | 12/1911 | Wilson | 160/7 |
| 1,077,468 | 11/1913 | Gilmore | 160/7 |
| 5,203,392 | 4/1993 | Shea | 160/7 |
| 5,245,879 | 9/1993 | McKeon | 160/7 X |
| 5,253,693 | 10/1993 | Marlatt et al. | 160/7 |
| 5,261,186 | 11/1993 | Saino | 160/1 X |
| 5,263,527 | 11/1993 | Marlatt et al. | 160/7 |
| 5,482,103 | 1/1996 | Burgess et al. | 160/7 X |

*Primary Examiner*—David M. Purol

*Attorney, Agent, or Firm*—Webb Ziesenheim Bruening Logsdon Orkin & Hanson, P.C.

[57] ABSTRACT

A rolling fire door includes a door hold-open/release system that includes an electromagnet which is energized by a controller when the door is in the open position. The energized electromagnet magnetically attracts a bottom bar of the rolling door to secure the door in the open position. A key control station connected to the controller enables the electromagnet to be energized when the door is in the open position and enables the controller to deenergize the electromagnet so that the weight of the door causes the door to close. The key control station also includes a test switch which enables the controller to deenergize the electromagnet after a delay interval. The controller also deenergizes the electromagnet after a delay interval in response to activation of an alarm or in response to a thermal switch sensing a temperature in excess of a set point temperature.

18 Claims, 3 Drawing Sheets

VAC
68
70
72
NC
NO
NC
NO
RL2
112
116
38
40
114
118
120
NO
122
NO
NC
NC
RL3
T2
CR3
124
106
104
110
88
126
42
102
130
128
T1
108
44
100
98
90
86
KEY CONTROL STATION
84
NO
RL1
NC
50
48
52
G
R
NC
NO
80
82
58
NO
NC
60
CR2
CR1
46
NO
56
NC
62
74
54
LOAD
SUPPLY
76
64
78

ROLLING FIRE DOOR INCLUDING A DOOR HOLD-OPEN/RELEASE SYSTEM

CROSS REFERENCE TO RELATED APPLICATION

This application claims the benefit of earlier filed U.S. Provisional patent application Ser. No. 60/029,358, filed on Oct. 31, 1996.

BACKGROUND OF THE INVENTION

1. Field of the Invention

This invention relates to rolling doors and more particularly to rolling fire doors having controls for holding such doors open and for automatically initiating the closing of such doors.

2. Description of the Prior Art

Rolling doors, and more particularly, rolling steel doors, are utilized to provide security and protection in commercial, institutional and industrial buildings. A typical rolling door includes a curtain positioned between a pair of vertical guides on opposite sides of an opening. The curtain is moveable upward in the guides to enable passage through the opening and is moveable downward to seal the opening and prevent passage therethrough.

A typical curtain includes a plurality of horizontally disposed slats pivotally interconnected together along their sides and having their opposite ends received in the guides positioned on the opposite sides of the opening. The bottom of the curtain typically has a bottom bar that may include a handle to permit the curtain to be manually opened. The top of the curtain is preferably connected to a shaft which is positioned above the guides. The shaft is rotatable around its longitudinal axis relative to a rigid support. A spring connected between the shaft and the rigid support applies to the shaft a torque that counterbalances at least a part of the weight of the door.

A rolling door may be moved to the open position by applying a lifting force to the handle of the bottom bar. When opened, the rolling door coils around the shaft until the weight of the door between the guides is insufficient to overcome the spring tension applied to the shaft. In another embodiment, a rotational torque is applied to a gear at one end of the shaft to cause the shaft to rotate thereby coiling the door thereabout. This rotational torque may be applied by an electric motor or by manually pulling a chain connected around the gear, as is known in the art.

When used as a fire door, these rolling doors must be returnable to their closed position under certain alarm conditions. To this end, prior art rolling fire doors include a release latch which secures the torque of the spring against the shaft. In response to a suitable alarm, such as a fire alarm, the release latch disengages from the spring and releases all or a part of the torque of the spring on the shaft. In the absence of torque on the shaft, the weight of the door causes the door to close.

A problem with the release latch, however, is that once released, the spring must be manually retorqued against the shaft and the release latch reengaged. This manual retorquing of the spring and reengaging of the release latch is time-intensive and potentially dangerous. Moreover, the time to retorque the spring around the shaft and reengage the release latch is a disincentive to testing the operation of the release latch on the spring.

It is therefore an object of the present invention to provide a rolling door hold-open/release system which overcomes these drawbacks of the prior art. It is an object of the present invention to provide a rolling door that has a door hold-open/release system which enables the rolling door to be lowered to a closed position without releasing tension on a spring. It is an object of the present invention to provide a delayed closing of a rolling door in response to detecting an over-temperature, alarm or power-out condition. It is an object of the present invention to provide a door hold-open/release system which retains a vertically-openable door, such as a rolling door, open and which enables closing of the door or delayed closing of the door in response to detecting a temperature in excess of a desired temperature, activation of an external alarm or activation of a test switch.

SUMMARY OF THE INVENTION

Accordingly, we have invented a rolling door that includes a pair of guides positioned in spaced relation and a curtain having a plurality of slats and a bottom bar. Each guide has a receiving slot therein and each slat has at least one side thereof pivotally interlocked with a side of an adjacent slat. Opposite ends of each slat are receivable in the receiving slots of the pair of guides. The bottom bar has a side connected to a side of an endmost slat of the curtain and has opposite ends thereof received in the receiving slots of the pair of guides. A shaft is positioned perpendicular to lengthwise axes of the pair of guides adjacent one end thereof. The shaft is connected to a side of one of the plurality of slats of the curtain opposite the bottom bar. The shaft is rotatable around a longitudinal axis thereof so that the curtain is coilable around the shaft. A counterbalance is connected to the shaft and applies thereto a force that partially opposes a weight of the curtain that resists coiling of the curtain around the shaft. A latch is fixedly positioned adjacent the shaft for engaging the bottom bar or the end of the curtain adjacent the bottom bar when the curtain is coiled around the shaft. The latch coacts with the bottom bar or the end of the curtain adjacent the bottom bar to secure the curtain coiled around the shaft. A controller connected to the latch selectively causes the latch to release the bottom bar or the end of the curtain adjacent the bottom bar so that the weight of the curtain causes the curtain to uncoil from the shaft.

Preferably, the latch includes an electromagnet energizable by the controller to produce a magnet attraction between the electromagnet and the one of the bottom bar and the end of the curtain adjacent the bottom bar. A reset switch connected to the controller is activatable to cause current to be supplied to the electromagnet. A close switch connected to the controller is activatable to terminate the supply of current to the electromagnet. A test switch, a thermal switch and/or an alarm switch is connected to a delay circuit which is connected to the electromagnet. The delay circuit is responsive to activation of the test switch, the thermal switch and/or the alarm switch to terminate the supply of current to the electromagnet a delay interval after activation thereof.

We have also invented a door retaining system for retaining a vertically-openable door open. The retaining system includes an electric actuatable latch positioned to secure the vertically-openable door open. A controller is connected to the latch for controlling the latching of the latch to secure the door open. A reset switch is connected to the controller for causing current to be provided to the latch in response to activation thereof. In response to current from the controller, the latch actuates to secure the door open. The controller includes a delay circuit that removes after a delay interval the current from the latch. The removal of current from the latch causes the latch to release the door.

We have also invented a method of controlling a vertically-openable door. The method includes the steps of (a) raising the vertically-openable door to an open position; (b) energizing an electrically actuatable latch to secure the door in the open position; (c) detecting (i) a temperature in excess of a desired temperature, (ii) activation of an external alarm and/or (iii) activation of the switch; and (d) deenergizing the latch in response to detecting (c)(i), (c)(ii), or (c)(iii), wherein deenergizing the latch enables the weight of the door to urge the door to a closed position.

DESCRIPTION OF THE PREFERRED EMBODIMENT

Figure 1:
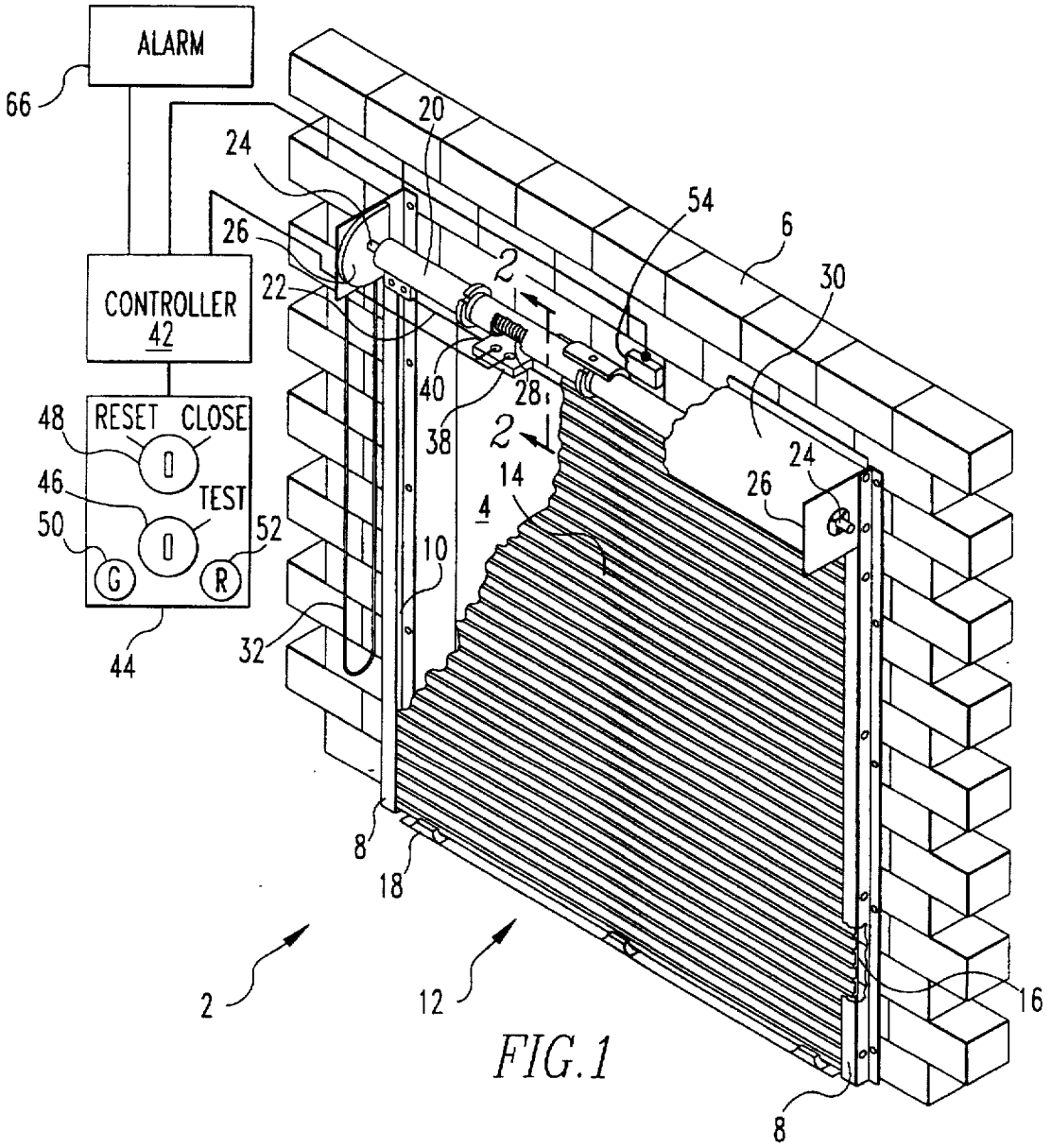
FIG. 1 shows a perspective view of a rolling door in accordance with the present invention including a controller connected to a key control station and a latch.

As shown in FIG. 1, a rolling door 2 is positionable to obstruct an opening 4 in a wall 6. The rolling door 2 includes a pair of guides 8 positioned in spaced relation on opposite sides of the opening 4. The guides 8 include vertically oriented receiving slots 10 which are positioned in opposition. A curtain 12 is positioned across the opening 4. The curtain 12 includes a plurality of horizontally oriented slats 14 having ends 16 thereof received in the receiving slots 10 of the guides 8. Each slat 14 has at least one side thereof pivotally interlocked with the side of an adjacent slat 14. A horizontally disposed bottom bar 18 is connected to a lower end of curtain 12, and more specifically an endmost slat 14 of the curtain 12, and has opposite ends thereof received in the receiving slots 10 of the guides 8.

A rotatable shaft 20 is positioned adjacent an end of the curtain 12 opposite the bottom bar 18. More particularly, the shaft 20 is positioned perpendicular to lengthwise axes of the guides 8 adjacent a header 22 of opening 4. The shaft 20 has ends 24 rotatably attached to rigid supports 26 which are connected to the wall 6. A counterbalance 28 is preferably connected between the shaft 20 and one or both of the rigid supports 26. The counterbalance 28 applies to the shaft 20 a torque that partially opposes the weight of the curtain 12 that resists coiling of the curtain 12 around the shaft 20. Preferably, the counterbalance 28 is a coil spring that is wound around its axis and connected between the shaft 20 and one or more of the rigid supports 26. The counterbalance 28, however, may include a counterweight (not shown) connected to the bottom bar 18 by a cable and pulley (not shown). Two or more counterbalances 28 may be utilized as necessary to counterbalance the weight of the curtain 12 to a desired extent.

Figure 2:
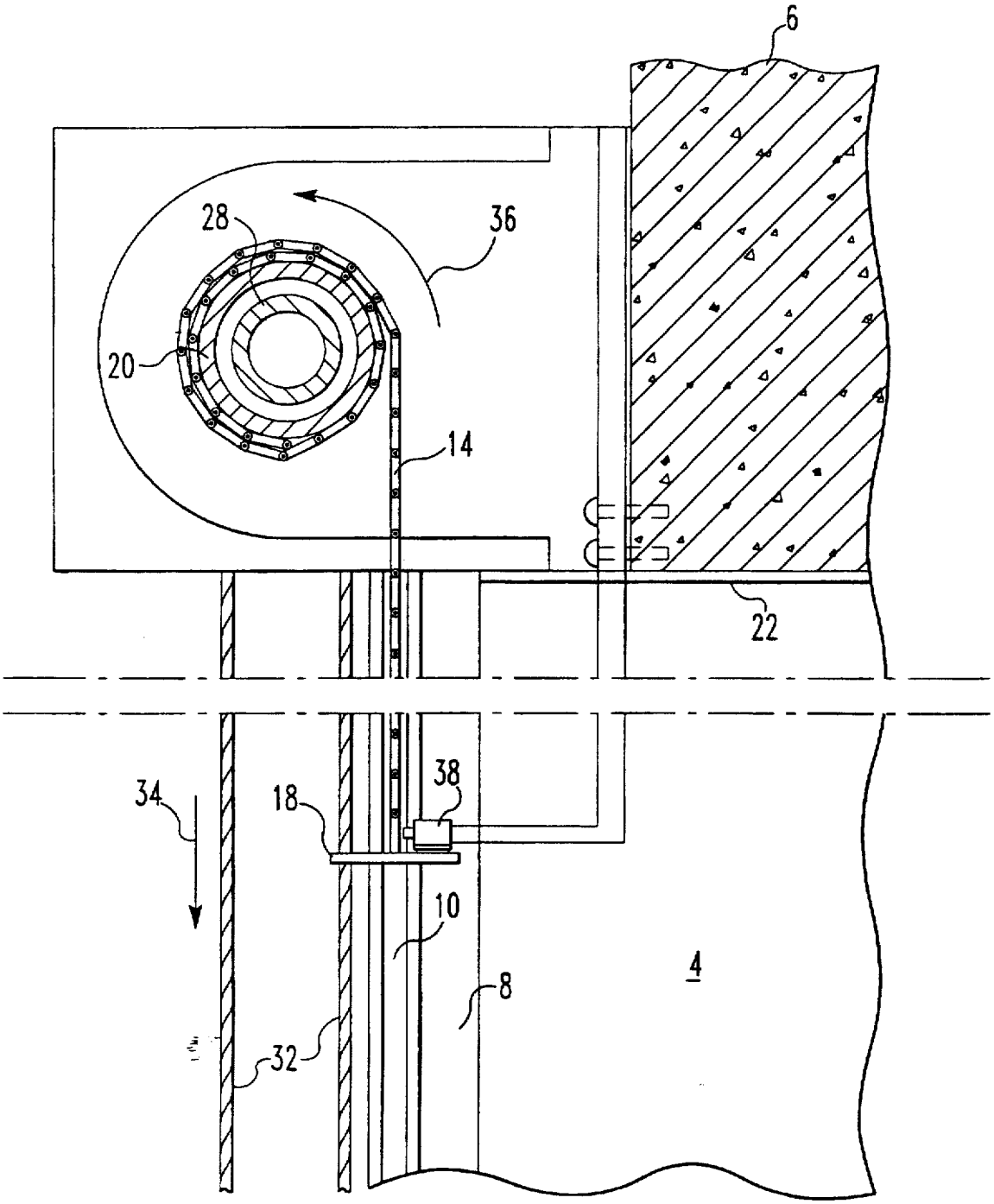
FIG. 2 is a sectional view taken along lines II—II in FIG. 1.

Preferably, a hood 30 is positioned over the shaft 20 and between the rigid supports 26. In the embodiment shown in FIG. 1, a continuous rope or chain 32 is disposed around a pulley (not shown) connected to the shaft 20 for rotation therewith. As shown in FIG. 2, applying a sufficient tension 34 to an appropriate side of the rope or chain 32 causes the shaft 20 to rotate about its axis in a direction 36 that causes the slats 14 of the curtain 12 to coil around the shaft 20.

A latch 38 is fixedly positioned adjacent the shaft 20 for engaging the bottom bar 18 or the end of the curtain 12 adjacent the bottom bar 18 when the curtain 12 is coiled around the shaft 20. The latch 38 coacts with the bottom bar 18 or the end of the curtain 12 adjacent the bottom bar 18 to maintain the curtain 12 coiled around the shaft 20. Preferably, the latch 38 includes an electromagnet 40 which magnetically engages the bottom bar 18 or a slat 14 of the curtain 12 adjacent the bottom bar 18 in response to energization of the electromagnet 40 by a controller 42.

A key control station 44 is connected to the controller 42 and controls the energization of the electromagnet 40. The key control station 44 includes a key-actuatable test switch 46, a key-actuatable reset-close switch 48, a green indicator lamp 50 and a red indicator lamp 52. Connected to the controller 42 is a thermal switch 54 which is preferably positioned to detect the temperature of the atmosphere near the rolling door 2. In response to detecting temperature in excess of a set-point temperature, the thermal switch 54 signals the controller 42.

Figure 3:
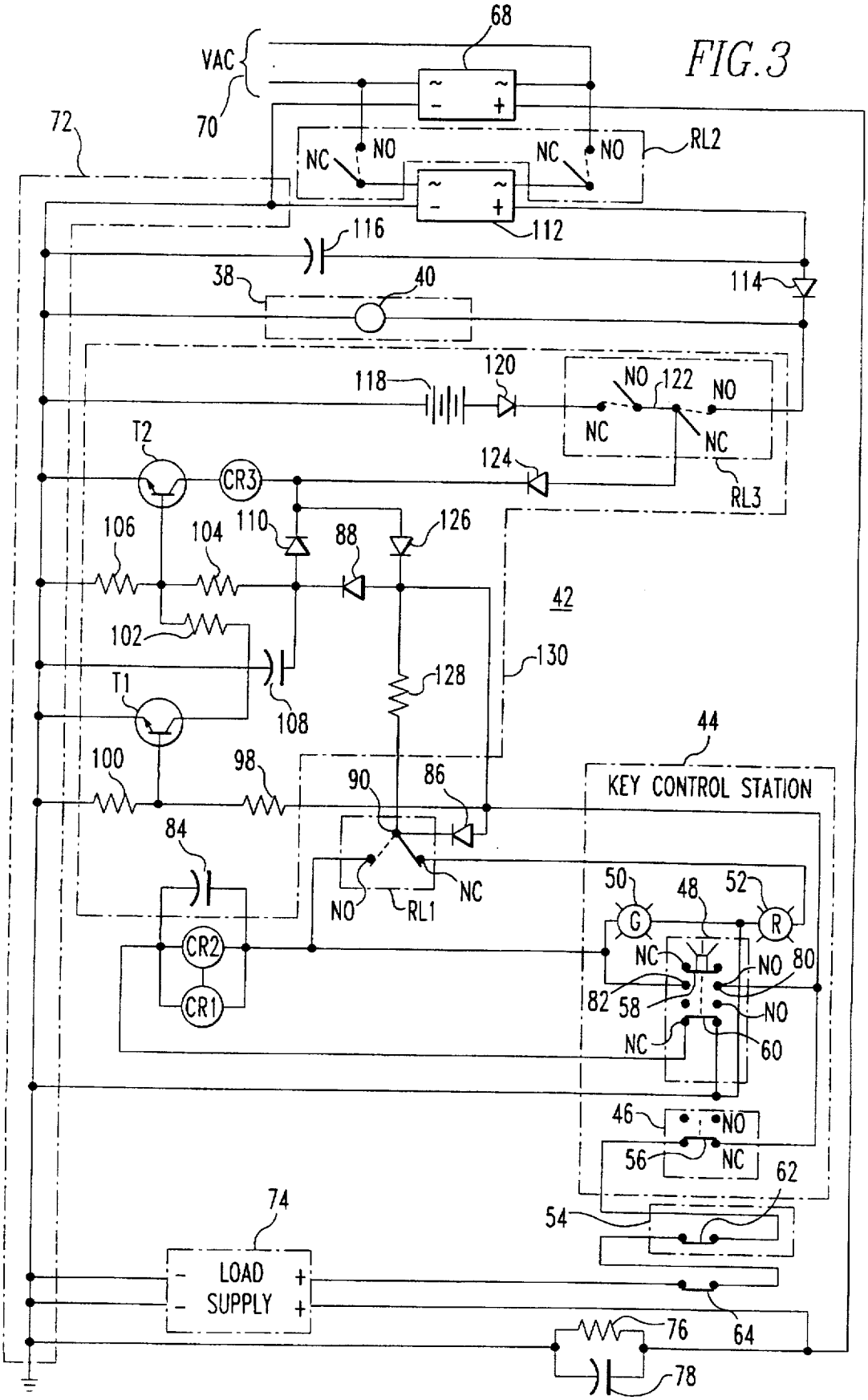
FIG. 3 is an electrical schematic of the controller, the key control station and the latch of FIG. 1.

With reference to FIG. 3 and with ongoing reference to all previous Figs., the test switch 46 includes contact 56 which is associated with a delayed deenergization of the electromagnet 40. Similarly, the reset-close switch 48 includes a contact 58 associated with a reset function of electromagnet 40 and a contact 60 associated with non-delayed deenergization of the electromagnet 40. The thermal switch 54 includes a bi-metallic contact 62 which changes to its open state in response to detecting a temperature in excess of a set-point temperature. Connected in series with the bi-metallic contact 62 is an alarm contact 64 which is energizable by an alarm 66 (shown in FIG. 1) connected to the controller 42.

The controller 42 includes a rectifier 68 which rectifies an incoming AC voltage 70 into rectified DC voltage. The rectifier 68 has a negative DC voltage terminal connected to a common or ground node 72 of the controller 42. Connected between a positive DC voltage terminal of the rectifier 68 and the common node 72 is a supply side of a voltage regulator 74, a resistor 76 and a capacitor 78. In response to receiving rectified DC voltage from rectifier 68, the voltage regulator 74 generates a regulated DC voltage on an output, or load, side thereof. A negative terminal of the load side of voltage regulator 74 is connected to the common node 72. A positive terminal of the load side of voltage regulator 74 is connected to a terminal 80 of contact 58 through alarm contact 64, bi-metallic contact 62 of thermal switch 54 and contact 56 of test switch 46. The green indicator lamp 50 is connected between a terminal 82 of the contact 58 and the common node 72. Connected between the normally closed contact 60 and the terminal 82 of normally open contact 58 is the parallel combination of capacitor 84, coil CR1 and coil CR2.

The terminal 80 of contact 58 is also connected to anodes of diodes 86 and 88. The cathode of diode 86 is connected to a common terminal 90 of a relay RL1 which changes state in response to current flowing through coil CR1. In the normally closed state, the relay RL1 connects the terminal 80 of contact 58 to the common node 72 through the red indicator lamp 52. However, in response to current flowing through coil CR1, relay RL1 switches state and connects terminal 80 of contact 58 to a terminal 82 of contact 58.

Connected in series between terminal 80 of contact 58 and common node 72 are resistors 98 and 100. Connected between resistor 98 and resistor 100 is a base terminal of a transistor T1 which has an emitter terminal connected to the common node 72 and a collector terminal connected to a base terminal of a transistor T2 through a resistor 102. Connected between the base terminal of transistor T2 and the cathode of diode 88 is a resistor 104. Connected between the base terminal of transistor T2 and the common node 72 is a resistor 106. Transistor T2 has an emitter terminal connected to the common node 72 and a collector terminal connected to one side of a coil CR3. A capacitor 108 is connected between the cathode of diode 88 and the common node 72. A diode 110 has its anode connected to the cathode of diode 88 and has its cathode connect to a side coil CR3 opposite the collector terminal of transistor T2.

A double-pole double-throw relay RL2, responsive to current flowing coil CR2, is positioned between the incoming AC voltage 70 and a rectifier 112 which converts the incoming AC voltage 70 into a DC voltage. The negative DC voltage terminal of the rectifier 112 is connected to the common node 72 and the positive DC voltage terminal of the rectifier 112 is connected to an anode of a diode 114. Connected between the positive terminal and the negative terminal of rectifier 112 is smoothing capacitor 116 which smooths out any voltage fluctuations or ripples in the DC voltage output by the rectifier 112. Connected between a cathode of diode 114 and the common node 72 is the latch 38 which includes the electromagnet 40. Also connected between the cathode of diode 114 and the common node 72 are the series combination of a battery 118, a diode 120 and a double-pole double-throw relay RL3. The battery 118 has a negative terminal connected to the common node 72 and a positive terminal connected to the anode of diode 120. The diode 120 has a cathode that is connected to one of the normally open terminals of relay RL3. The cathode of diode 114 is connected to the other normally open terminal of relay RL3. The terminals of relay RL3 not connected to diodes 114 and 120 are connected together to form a node 122 which is connected to an anode terminal of a diode 124. The diode 124 has a cathode terminal that is connected to the cathode terminal of diode 110, the anode terminal of a diode 126 and to the side of coil CR3 opposite the collector terminal of transistor T2. The diode 126 has a cathode terminal that is connected to the common terminal 90 of relay RL1 through a resistor 128.

When incoming AC voltage 70 is initially applied to the rectifier 68, current is not flowing through coils CR1–CR3 and, therefore, relays RL1–RL3 are in a normally closed state, as shown by solid lines in FIG. 3. The rectifier 68 converts the incoming AC voltage 70 into the DC voltage that is provided to the voltage regulator 74. The voltage regulator 74 converts the DC voltage from rectifier 68 into the regulated DC voltage which is provided to the key control station 44 through the alarm contact 64 and the bi-metallic contact 62 of the thermal switch 54. The regulated AC voltage provided to the key control station 44 is provided to the red indicator lamp 52 through contact 56 of test switch 46, diode 86 and the normally closed contact of relay RL1. In response to the regulated DC voltage, the red indicator lamp 52 illuminates thereby providing a visual indication that incoming AC voltage 70 is provided to the controller 42.

The regulated DC voltage provided to the key control station 44 is also provided to resistors 98 and 100. The voltage across resistors 98, 100 bias transistor T1 into conduction whereby the potential at the common node 72 is substantially impressed at the collector terminal of transistor T1. The regulated AC voltage is also provided to the resistors 102, 104 and 106 through the diode 88. With transistor T1 in conduction, resistors 102 and 104 are connected in parallel between the base terminal of transistor T2 and the common node 72. The parallel connection of resistors 102 and 106 in series with resistor 104 provides to the base terminal of transistor T2 a bias that is insufficient to bias transistor T2 into conduction.

When it is desired to energize the electromagnet 40, the reset-close switch 48 is cycled from a neutral position to a reset position which causes the contact 58 to switch to the normally open state. With contact 58 in the normally open state, the regulated DC voltage is provided to coils CR1 and CR2 and capacitor 84. The regulated DC voltage provided to coils CR1 and CR2 causes DC current to flow therethrough to contact 60 and common node 72. The current flowing through coils CR1 and CR2 cause the contacts of relays RL1 and RL2 to switch to the normally open state shown by dashed lines in FIG. 3. With contact 58 and relay RL1 in the normally open state, the green indicator lamp 50 is illuminated by the regulated DC voltage. Similarly, switching the relay RL1 from the normally closed state isolates the red indicator lamp 52 from the regulated DC voltage thereby extinguishing the red indicator lamp 52.

Switching relay RL2 to the normally open state connects the incoming AC voltage 70 to the rectifier 112. The rectifier 112 converts the incoming AC voltage 70 into a DC voltage that is provided to the electromagnet 40 through diode 114. In response to the supply of DC voltage from rectifier 112, the electromagnet 40 produces a magnetic field that attracts the bottom bar 18 positioned closely adjacent thereto. The magnetic attraction between the electromagnet 40 and the bottom bar 18 is of sufficient extent to maintain the curtain 12 coiled around the shaft 20. In the absence of magnetic attraction between the electromagnet 40 and the bottom bar 18, the weight of the curtain 12 is of sufficient extent to cause the curtain 12 to uncoil from the shaft 20 against the torque of the counterbalance 28.

When relay RL1 switches to the normally open state, the reset-close switch 48 can be cycled back to the neutral position whereby contact 58 switches to its normally closed state and the regulated DC voltage is not provided therethrough. Hence, contact 58, responsive to the reset position of reset-close switch 48, provides a momentary path for the regulated DC voltage to green indicator lamp 50 and coils CR1 and CR2 until relay RL1 switches to the normally open state.

When it is desired to close the door in normal operation, the reset-close switch 48 is cycled from the neutral position to a close position which causes the contact 60 to switch to a normally open state thereby isolating coils CR1 and CR2, capacitor 84 and the green indicator lamp 50 from the common node 72. This isolation causes current to cease flowing through coils CR1 and CR2 which causes relays RL1 and RL2 to return to their normally closed state.

When the relay RL1 returns to its normally closed state, the red indicator lamp 52 is connected to the regulated DC voltage. Returning relay RL2 to its normally closed state isolates the rectifier 112 from the incoming AC voltage. This isolation terminates the supply of DC voltage from the rectifier 112 to the electromagnet 40. In the absence of DC voltage, the electromagnet 40 deenergizes and terminates the magnetic attraction between the electromagnet 40 and the bottom bar 18. In the absence of this magnetic attraction, the weight of the curtain 12 is sufficient to uncoil the curtain 12 from the shaft 20 and close the opening 4. When the electromagnet 40 is deenergized, the reset-close switch 48 can be cycled back to its neutral position whereby contact 60 returns to its normally closed state. Thereafter, the curtain 12 may be raised by coiling it around the shaft 20 and the reset-close switch 48 may be cycled to the reset position to cause the magnetic attraction to be generated between the electromagnet 40 and the bottom bar 18, in the above-described manner.

The controller 42 has a delay circuit 130 that includes resistors 98–106 and 128; capacitors 84 and 108; diodes 88, 110, 120, 124 and 126; transistors T1 and T2; coil CR3; relay RL3; and battery 118. The delay circuit 130 delays deenergization of electromagnet 40 in response to isolating the delay circuit 130 from the regulated DC voltage generated by the voltage regulator 74. The delay circuit 130 can be isolated from the regulated DC voltage by activating test switch 46 thereby causing contact 56 to switch to the normally open state; activating the thermal switch 54 to open contact 62; or activating the alarm 66 to open alarm contact 64. Preferably, the alarm 66 is a fire alarm which can cause the alarm contact 64 to open in response to detecting an alarm condition. The delay circuit 130 can also be isolated from the regulated DC voltage when the supply of incoming AC voltage 70 is terminated.

When the delay circuit 130 is isolated from the DC regulated voltage, the transistor T1 becomes non-conducting the resistor 102 is isolated from the common node 72 and the capacitor 108 supplies voltage to resistors 104 and 106. The isolation of resistor 102 from the common node 72 changes the voltage drop across resistors 104 and 106 which changes the bias to the base of transistor T2. This change in bias causes transistor T2 to conduct current from capacitor 108 through diode 110 and coil CR3. The current flowing through coil CR3 causes relay RL3 to change to its normally open state shown in dashed lines in FIG. 3.

To delay relays RL1 and RL2 returning to their normally closed state in the absence of regulated DC voltage, capacitor 84 supplies current to coils CR1 and CR2 until relay RL3 switches to its normally open state. When relay RL3 switches to its normally open state, current flows from the rectifier 112 to the coils CR1 and CR2 through one of the poles of relay RL3, diodes 114, 124 and 126, resistor 128, and relay RL1. With relay RL3 in the normally open state, rectifier 112 also provides current to coil CR3 through one pole of relay RL3 and diodes 114, 124.

The orientation of diode 110 enables capacitor 108 to supply current to coil CR3 to close relay RL3. However, when current is provided to coil CR3 through relay RL3, the voltage at the cathode side of diode 110 is greater than the voltage at the anode side thereof. This is particularly so when the voltage across capacitor 108 has decreased in response to supplying current to coil CR3 and to resistors 104 and 106. When the voltage on the cathode side of diode 110 is greater than the voltage on the anode side, the capacitor 108 no longer supplies current to coil CR3. Hence, the remaining charge in capacitor 108 is utilized to bias transistor T2 in conduction via resistors 104 and 106.

When capacitor 108 has discharged sufficiently, transistor T2 becomes nonconducting which isolates coil CR3 from the common node 72 thereby terminating the flow of current through coil CR3. The absence of current flowing through coil CR3 causes relay RL3 to return to its normally closed state which isolates coils CR1 and CR2 and delay circuit 130 from rectifier 112. Isolating coils CR1 and CR2 from the rectifier 112 terminates the flow of current through coils CR1 and CR2 which causes relays RL1 and RL2 to return to their normally closed state. Returning relay RL2 to its normally closed state isolates rectifier 112 from the incoming AC voltage 70 thereby terminating the flow of current through the electromagnet 40. The absence of current flowing through the electromagnet 40 terminates the magnetic attraction between the electromagnet 40 and the bottom bar 18. Because the weight of the door is sufficient to overcome the torque applied to the shaft 20 by the counterbalance 28, the door lowers to a closed position.

If the delay circuit 130 switches relay RL3 to its normally open state in response to termination of the supply of incoming AC voltage 70, the battery 118 supplies current to coil CR3 through diodes 120, 124 and the pole of relay RL3 positioned therebetween. The battery 118 also supplies current to the electromagnet 40 through diode 120 and the poles of relay RL3 and supplies current to coils CR1–CR2 through diodes 120, 124, 126, resistor 128 and relays RL1 and RL3. Hence, in the absence of incoming AC voltage 70, the battery 118 supplies current to coils CR1–CR3 and the electromagnet 40 until the voltage across capacitor 108 decreases sufficiently to cause transistor T2 to become nonconducting.

In a preferred embodiment, the capacitor 108 stores sufficient charge to delay deenergization of the electromagnet 40 for a desired delay interval, e.g., 10 seconds. Similarly, the capacitor 84 stores sufficient charge to maintain current flowing to coils CR1 and CR2 for an interval sufficient for relay RL3 to change to the normally open state so that current is supplied to coils CR1 and CR2 therethrough.

If, while transistor T2 is conducting, the regulated DC voltage is reapplied to the delay circuit 130, the delayed deenergization of the electromagnet 40 will be terminated and the magnetic attraction between electromagnet 40 and the bottom bar 18 will continue uninterrupted.

Based on the foregoing, it can be seen that the delay circuit 130 enables power to be provided to the electromagnet 40 for a delay interval, e.g., 10 seconds, after the delay circuit 130 is isolated from the regulated DC voltage generated by the voltage regulator 74. The regulated DC voltage can be isolated from delay circuit 130 by changing to the normally open state contact 56 of test switch 46, opening contact 62 of thermal switch 54 or opening contact 64 associated with alarm 66. Moreover, when the supply of incoming AC voltage 70 is terminated, the delay circuit 130 operates to maintain energizing current to the electromagnets 40 for the delay interval. Hence, the weight of the door acting to uncoil curtain 12 from the shaft 20 can be delayed under undesirable temperature, alarm or test conditions or when the supply of incoming AC voltage 70 is terminated. Moreover, the present invention provides a door retaining system which in normal use can retain a vertically-openable door open and which enables immediate closing of the door.

The invention has been described with reference to the preferred embodiment. Obvious modifications and alterations will occur to others upon reading and understanding the preceding description. For example, two or more electromagnets 40 may be utilized, two or more bi-metallic contacts 62 or two or more alarm contacts 64 may be utilized as required by the application. Moreover, while described in connection with a rolling door, the controller can also be utilized with other types of vertically-openable doors, such as a rolling grate or a conventional garage door. It is intended that the invention be construed as including all such modifications and alterations insofar as they come within the scope of the appended claims or the equivalents thereof.

We claim:

1. A rolling door comprising:

a pair of guides positioned in spaced relation, each guide having a receiving slot therein;

a curtain having a plurality of slats and a bottom bar, each slat having at least one side thereof pivotally interlocked with a side of an adjacent slat and having opposite ends thereof receivable in the receiving slots of the pair of guides, the bottom bar having a side thereof connected to a side of an endmost slat of the curtain and having opposite ends thereof received in the receiving slots of the pair of guides;

a shaft positioned perpendicular to lengthwise axes of the pair of guides adjacent one end thereof, the shaft connected to a side of one of the plurality of slats of the curtain opposite the bottom bar, the shaft rotatable around a longitudinal axis thereof so that the curtain is coilable around the shaft;

a counterbalance connected to the shaft and applying thereto a force that partially opposes a weight of the curtain that resists coiling of the curtain around the shaft;

a latch fixedly positioned adjacent the shaft for engaging one of the bottom bar and the end of the curtain adjacent the bottom bar when the curtain is coiled around the shaft, the latch coacting with the one of the bottom bar and the end of the curtain adjacent thereto to secure the curtain coiled around the shaft; and a controller connected to the latch, the controller selectively causing the latch to release the one of the bottom bar and the end of the curtain adjacent thereto so that the weight of the curtain causes the curtain to uncoil from the shaft, wherein:

the latch includes an electromagnet energizable by the controller to produce a magnetic attraction between the electromagnet and the one of the bottom bar and the end of the curtain adjacent the bottom bar; and a reset switch connected to the controller and activatable to cause current to be supplied to the electromagnet.

2. The rolling door as set forth in claim 1, further including a close switch connected to the controller and activatable to terminate the supply of current to the electromagnet.

3. The rolling door as set forth in claim 1, further including:

at least one of a test switch, a thermal switch and an alarm switch; and a delay circuit connected to the electromagnet and responsive to activation of the at least one of the test switch, the thermal switch and the alarm switch to terminate the supply of current to the electromagnet after a delay interval.

4. The rolling door as set forth in claim 3, wherein two or more of the test switch, the thermal switch and the alarm switch are connected in series between the delay circuit and a voltage source.

5. The rolling door as set forth in claim 3, further including:

a rectifier for rectifying incoming AC voltage to a DC voltage utilized to supply current to the electromagnet; and a battery connected to supply current to the delay circuit and the electromagnet in response to the supply of incoming AC voltage being terminated.

6. The rolling door as set forth in claim 1, wherein the counterbalance is a coil spring to apply a spring torque connected between the shaft and a rigid support.

7. A door retaining system for retaining a vertically-openable door open, the retaining system comprising:

an electric actuatable latch positioned to secure the vertically-openable door open;

a controller connected to the latch for controlling the actuation of the latch to secure the door open, the controller including a delay circuit; and a reset switch connected to the controller, wherein:

the controller causes current to be provided to the latch in response to activation of the reset switch;

the latch actuates and secures the door open in response to current being supplied to the latch;

the delay circuit removes after a delay interval the current from the latch; and the removal of current from the latch causes the latch to release the door.

8. The door retaining system as set forth in claim 7, wherein the delay interval of the delay circuit is initiated in response to a supply of incoming AC voltage being terminated.

9. The door retaining system as set forth in claim 7, further including at least one of:

a close switch connected to the controller and activatable to terminate the supply of current to the latch;

a thermal switch connected to the controller and activatable in response to sensing a temperature in excess of a set-point temperature;

an alarm switch connected to the controller and activatable in response to an alarm; and a test switch connected to the controller, wherein activation of at least one of the thermal switch, the alarm switch and the test switch initiates the start of the delay interval of the delay circuit.

10. The door retaining system as set forth in claim 7, further including:

a battery connectable by the delay circuit to provide current to the latch during the delay interval.

11. The door retaining system as set forth in claim 9, further including a rectifier which converts incoming AC voltage to a DC voltage utilized to provide the current to the latch.

12. The door retaining system as set forth in claim 7, wherein the latch includes an electromagnet that is energizable to produce a magnetic attraction between the electromagnet and a door.

13. The door retaining system as set forth in claim 9, wherein the alarm is a fire alarm.

14. A method of controlling a vertically-openable door, the method comprising the steps of:

(a) raising a vertically-openable door to an open position, with the door connected to a counterbalance that partially opposes a weight of the door that resists the opening thereof;

(b) energizing an electrically actuatable latch to secure the door in the open position;

(c) detecting at least one of (i) a temperature in excess of a desired temperature, (ii) activation of an external alarm, and (iii) activation of a switch; and (d) deenergizing the latch in response to detecting the at least one of (c)(i), (c)(ii) and (c)(iii), wherein:

deenergizing the latch enables the weight of the door to urge the door to a closed position; and the latch includes an electromagnet that is energizable by a current to produce between the electromagnet and the door a magnetic attraction which secures the door open.

15. The method of controlling the vertically-openable door as set forth in claim 14, wherein step (b) includes the step of activating a reset switch to cause the current to flow to the electromagnet.

16. The method of controlling the vertically-openable door as set forth in claim 14, further including the steps of:

converting incoming AC voltage to a DC voltage utilized to supply the current utilized to energize the latch; and delaying the deenergization of the latch for a delay interval in response to the supply of incoming AC voltage being terminated.

17. A method of controlling a vertically-openable door, the method comprising the steps of:

(a) raising a vertically-openable door to an open position, with the door connected to a counterbalance that partially opposes a weight of the door that resists the opening thereof;

(b) energizing an electrically actuatable latch to secure the door in the open position;

(c) detecting at least one of (i) a temperature in excess of a desired temperature, (ii) activation of an external alarm, and (iii) activation of a switch; and (d) deenergizing the latch in response to detecting the at least one of (c)(i), (c)(ii) and (c)(iii), wherein:

deenergizing the latch enables the weight of the door to urge the door to a closed position; and step (d) includes the step of delaying the deenergization of the latch for a delay interval after detecting the at least one of (c) (i), (c) (ii) and (c) (iii).

18. A vertically-openable door comprising:

a vertically-moveable door that extends between sides of an opening;

a spring connected to provide a force that partially opposes a weight of the door that resists vertical opening thereof;

an electrically actuatable latch; and a controller connected to the electrically actuatable latch to provide a current thereto that causes the electrically actuatable latch to secure the door in a vertically open position, wherein:

in the absence of the electrically actuatable latch securing the door vertically open the weight of the door urges the door to a closed position; and the electrically actuatable latch is an electromagnet that is energizable by the controller to produce a magnetic attraction between the door and the electromagnet.

* * * * *